US005167728A

United States Patent [19]

Weber

[11] Patent Number: 5,167,728

[45] Date of Patent: Dec. 1, 1992

[54] CONTROLLED GRAIN SIZE FOR ODS IRON-BASE ALLOYS

[75] Inventor: John H. Weber, Huntington, W. Va.

[73] Assignee: Inco Alloys International, Inc., Huntington, W. Va.

[21] Appl. No.: 690,514

[22] Filed: Apr. 24, 1991

[51] Int. Cl.[5] ..... C22C 1/00; C21D 8/00

[52] U.S. Cl. ..... 148/514; 419/67; 419/28

[58] Field of Search ..... 148/11.5 R, 12 R

[56] References Cited

U.S. PATENT DOCUMENTS 3,992,161 11/1976 Cairns et al. ..... 29/182.5
4,075,010 2/1978 Fischer ..... 75/235
4,531,981 7/1985 Singer ..... 148/11.5
4,732,622 3/1988 Jones ..... 148/11.5
5,032,190 7/1991 Suarez et al. ..... 148/11.5 R

*Primary Examiner*—Upendra Roy
*Attorney, Agent, or Firm*—Edward A. Steen; Blake T. Biederman

[57] ABSTRACT

The process of the invention relates to forming MA iron-base ODS alloys. A billet of iron-base ODS alloy is provided. The billet is consolidated at a temperature within a predetermined range of sufficient temperature for formation of coarse and/or fine grain sizes during a final heat treatment. The consolidated billet is worked into final form. The object is annealed to recrystallize grains to a size determined by the temperature of the consolidation and the working of the extruded billet.

10 Claims, No Drawings

CONTROLLED GRAIN SIZE FOR ODS IRON-BASE ALLOYS

FIELD OF INVENTION

This invention is related to oxide dispersion strengthened (ODS) iron-base alloys. More particularly, this invention is related to an improved method of forming mechanically alloyed (MA) oxide dispersion strengthened sheet with controlled grain size.

BACKGROUND OF THE INVENTION

Iron-base oxide dispersion strengthened alloys (iron-base ODS alloys) have been developed for high temperature applications. Chromium and aluminum are typically added to an iron-base alloy for resistance to oxidation, carburization and hot corrosion. The alloy is strengthened with an oxide stable at high temperature, such as yttrium oxide. The oxide is uniformly distributed throughout the alloy as a finely distributed dispersoid by mechanically alloying the powder. Iron-base ODS alloys in the form of sheet are particularly useful for gas-turbine combustion chambers, components of advanced energy-conversion systems and high temperature vacuum furnaces.

Generally, very coarse grains are desired in MA iron-base ODS alloys for high temperature rupture strength. The coarsening of the grains provides for increased rupture strength and decreased ductility. In sheet products, a minimum number of grains traversing the thickness may be required to provide optimal high temperature rupture strength. Typically, MA iron-base ODS alloys produced by a combination of extrusion and rolling have less than 3 to 4 grains comprising the sheet thickness. The small number of grains may cause mechanical properties to be quite variable depending on the number of grains, the orientation of the grain boundaries with respect to the axis of loading, and the orientation of the grains themselves. Variability in properties means that the designer must lower the design stresses to below that for the weakest experienced material. In addition, alloy ductility with coarse grains may also be erratic.

Properties of sheet iron-base alloys are extremely process dependent. The forming history of sheet controls ultimate strength properties produced. For high temperature rupture strength it is desired to form a coarse pancake type grain structure by performing a combination of longitudinal and cross rolling. The pancake structure provides isotropic properties in the rolling and transverse directions. Forming MA iron-base powder into sheet has required a combination of hot working operations and cold working operations. Between cold rolling operations, an intermediate temperature anneal is typically used to increase ductility. Suarez et al, is U.S. Pat. No. 5,032,190 an improved process for achieving isotropic properties in the rolling and transverse directions.

MA iron-base alloys have been formed into sheet using a multi-step process. First, iron-base alloys have been prepared by mechanical alloying metal powder components to form a suitable MA powder. MA powder was then encased in steel cladding to form a billet. The billet was then extruded at 1066° C. and hot rolled at elevated temperature.

A pickling operation was then used to remove the can. To finish the sheet, the sheet was cold rolled at a temperature slightly above room temperature such as 100° C. to final size. Cold working is defined as rolling at a temperature at which work hardening occurs during deformation with very little, if any, work softening or relaxation. Cold rolling at temperatures slightly above room temperature was required because iron-base ODS alloys may have a ductile to brittle transition temperature at about room temperature. Optionally, an intermediate temperature anneal at about 1090° C. may be used in between a series of cold rolling operations to increase ductility. It is recognized that an intermediate temperature anneal may also affect the transition temperature. Cold working is desired to produce a sheet as close to finished gage as possible and to prevent oxide formation. However, cold working of ODS iron-base sheet has often produced sheet having less than 3 to 4 grains per thickness after a final anneal at about 1370° C. This large grain size increases stress rupture strength, but it does not provide the often desired properties of decreased dependence upon grain orientation.

It is an object of this invention to provide a method for increasing control of ultimate grain size formed of annealed MA iron-base alloy.

It is an object of this invention to decrease final grain size of annealed MA iron-base alloy that has been hot worked and cold worked to finished size.

It is further an object of this invention to provide a method for decreasing grain orientation dependence and to increase sheet ductility of MA iron-base alloys.

SUMMARY OF INVENTION

The process of the invention relates to forming MA iron-base ODS alloy. A billet of iron-base ODS alloy is provided. The billet is consolidated at a temperature within a predetermined range of sufficient temperature for formation of coarse and fine grain sizes. The consolidated billet is worked into final form. The object is annealed to recrystallize grains to a size determined by the temperature of the consolidation and the working of the extruded billet.

DESCRIPTION OF PREFERRED EMBODIMENT

The method of the invention provides for controlling the grain size of an iron-base alloy. Control of consolidation temperature is used to increase the range of grain size ultimately producible. A combination of consolidation temperature and work history is used to control grain size and the number of grains across a given thickness of MA iron-base ODS alloy after a final anneal at a temperature of at least about 1340° C.

Iron-base alloys that are particularly subject to excess coarsening include about 10 to 40% chromium and about 1 to 10% aluminum. In particular, the method of the invention would be especially successful for alloy MA 956. Alloy MA 956 is an iron-base ODS alloy having the following nominal composition by weight percent:

| | |
|---|---|
| Iron | 74 |
| Chromium | 20 |
| Aluminum | 4.5 |
| Titanium | 0.5 |
| Yttrium Oxide ($Y_2O_3$) | 0.5 |

To produce alloys having decreased grain size, mechanically alloyed iron-base ODS alloy powder is introduced into a container. This operation consists of packing powder into a steel can. The steel canned powder is then consolidated at a temperature above about 1100° C. For purposes of the specification and claims, consolidation refers to methods of increasing density such as hot pressing, hot isostatic pressing and extrusion. For a further decrease in grain size, temperatures between 1121° C. and 1232° C. are used to consolidate the alloy. The consolidated MA iron-base ODS alloy is then preferably rolled at elevated temperature for initial thickness reduction. After rolling at elevated temperature, cold rolling at a temperature slightly above ambient is used to reduce to final thickness. The cold rolled material is work hardened with a very fine grain structure. For purposes of this specification, a coarse grain size is defined as a grain size above 10 micrometers and a fine grain size is defined a grain size below 10 micrometers. A final anneal is then used to recrystallize grains and relieve the stress from work hardening and coarsen the grains. For iron-base ODS alloys such as alloy MA 956 a combination of work history and high temperature is used to achieve grain coarsening. Work history from conventional hot consolidation, hot rolling and cold rolling provides conditions for producing coarse grains upon final anneal. However, billet consolidating at temperatures above 1100° C. provides flexibility in processing allowing production of coarse or fine grains.

Samples were prepared using a 4 S attritor operated at 288 rpm under an argon atmosphere with a flow rate of 330 $cm^3$/min. A processing time of 30 hours was used at a ball-to-powder ratio of 20:1. MA iron-base alloy produced had the composition (in weight percent) of:

| Cr | Al | Co | $Y_2O_3$ | C | O | N | Fe |
|---|---|---|---|---|---|---|---|
| 20.8 | 5.5 | 0.98 | 0.86 | 0.02 | 0.49 | 0.093 | Balance |

The attrited powders were canned and extruded through a 2.06 cm×5.72 cm die having a 6 to 1 extrusion ratio. Samples were extruded at 38.1 cm/sec at 982° C. and 1065° C. A sample extruded at 982° C. was elevated temperature rolled to a thickness of 1.27 cm, 0.635 cm and 0.318 cm in sequential elevated temperature rolling operations at 1093° C. A sample extruded at 1065° C. was elevated temperature rolled to a thickness of 1.27 cm, 0.635 cm and 0.318 cm in sequential elevated temperature rolling operations at 1204° C. The sample extruded at 1065° C. had a 1 mm grain length much shorter than the 10 mm grain length of samples extruded at 982° C. Subsequent testing has attributed grain size control primarily to consolidation temperature rather than rolling temperature. However, it is recognized that through modified or additional working, a coarse grain structure may be produced.

Two samples of MA-Fe-Cr-Al alloy containing 0.5% $Y_2O_3$ were prepared in 4000 gram batches in a 4 S attritor using 0.79 cm diameter 52100 steel balls. A pure argon atmosphere was used with a flow rate of approximately 200 cc/min to maintain a tank pressure of approximately 21 KPa. Powders were canned in cleaned 8.89 cm diameter mild steel cans which were sealed without evacuation. Powder cans were extruded at 982° C. and 1065° C. to a 6.03×1.90 cm cross section using oil and glass lubrication and graphite follower blocks. Samples were given a 1 hour heat treatment at 1316° C. followed by air cooling. Samples extruded at 982° C. recrystallized and grew to a coarse structure. Samples extruded at 1065° C. produced a grain structure much finer than samples extruded at 982° C.

An extrusion of an iron-base MA956 alloy at 1270° C. followed by cold rolling and a heat treatment at 1371° C. yielded a strip with a 2–5 micrometer grain size. This 2–5 micrometer grain size provides thin sheet that is not as dependent upon on individual grain orientations. Generally, the greater the forming temperature of the billet, the smaller the grain size of the annealed product. Cold working an alloy after consolidation at temperature of at least 1100° C., has been found to be capable of producing a fine controlled ultimate grain size after recrystallization.

It has been found that higher consolidating temperatures (at least 1100° C.) improve control of the final annealed grain size. When consolidating at temperatures of at least 1100° C., subsequent elevated temperature working and final annealing conditions may be adjusted to produce coarse or fine grains. In contrast, an extrusion consolidating step at 871° C.–927° C. followed by cold work and annealing at 1340° C.–1400° C. provides for a large grain structure.

The maximum final grain size for eliminating crystal orientation dependency is determined by sheet thickness. It is desired that grains have a thin flat pancake structure in the sheet plane. This provides for the longest grain path across the sheet thickness. For example, a sheet thickness of 1.27 mm preferably has an average grain thickness of about 0.127 mm or less and a sheet thickness of 0.05 mm preferably has an average grain thickness of 5 microns or less. This maintains the average number of grains across a thickness at 8 to 10 or more. The lower limit for thickness of MA iron-base ODS alloys is about 0.05 mm. The process of the invention has been successfully used to provide grains having an average grain thickness as fine as 2–5 microns. This would provide an average of about 10 grains across a sheet having a thickness as thin as 0.02 mm.

In conclusion, the invention provides for increased grain size control after final annealing. Most advantageously, the invention provides a method for decreasing final grain size of iron-base ODS alloy by increasing consolidating temperature prior to working. The invention facilitates the use of a final cold working operation to reduce sheets final thickness without forming coarse grains upon recrystallization. A fine grain product maintains low temperature ductility. The process of the invention has been used to produce grains as small as about 2–5 micrometers. This small grain size allows for thin sheets of MA 956 to be formed using initial hot working and final cold working operations.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A method for production of mechanically alloyed iron-base ODS alloys in a manner which allows for flexibility in final grain size comprising:

a) providing an iron-base ODS billet of mechanically alloyed iron-base ODS alloy powder, b) consolidating said billet within a predetermined temperature range above 1100° C. of sufficient temperature to provide for formation of products having the final grain size ranging from fine to coarse following a final heat treatment, c) working said consolidated billet into an object of final form, and d) final annealing said object at a temperature of at least about 1340° C. to recrystallize grains to the final grain size determined by said temperature of said consolidation and said working of said consolidated billet.

2. The method of claim 1 wherein said billet is consolidated at a temperature between about 1121° C. and 1232° C.

3. The method of claim 1 wherein the final grain size of said object is less than 5 microns.

4. The method of claim 1 wherein said billet is rolled at a temperature slightly above room temperature into sheet.

5. The method of claim 1 wherein said mechanically alloyed iron-base ODS alloy contains by weight percent about 10 to 40% chromium, and about 1 to 10% aluminum.

6. The method of claim 1 wherein said annealing is at a temperature of about 1340° C.-1400° C.

7. The method of claim 1 wherein said consolidating includes extruding.

8. A method for production of mechanically alloyed iron-base ODS alloys in a manner which allows for flexibility in final grain size comprising:

a) providing an iron-base ODS billet of mechanically alloyed iron-base ODS alloy powder, said iron-base ODS alloy containing by weight percent about 10 to 40% chromium and about 1 to 10% aluminum, b) consolidating said billet at a temperature between about 1121° C. and 1232° C. to provide for formation of products having the final grain size ranging from fine to coarse following a final heat treatment, c) reducing thickness of said billet at elevated temperature, d) cold rolling said consolidated billet into sheet to a final thickness, and e) final annealing said sheet at a temperature of about 1340° C.-1400° C. to recrystallize grains to the final grain size determined by said temperature of consolidation, said reducing and said rolling.

9. The method of claim 8 wherein said consolidating includes extruding.

10. The method of claim 8 wherein the final grain size of said object is less than 5 microns.

* * * * *